US007870765B2

(12) United States Patent
Shatskin

(10) Patent No.: US 7,870,765 B2
(45) Date of Patent: Jan. 18, 2011

(54) SAFING LOCK MECHANISM

(75) Inventor: Leonid Shatskin, Wheaton, IL (US)

(73) Assignee: Scot Incorporated, Downers Grove, IL (US)

( * ) Notice: Subject to any disclaimer, the term of this patent is extended or adjusted under 35 U.S.C. 154(b) by 1050 days.

(21) Appl. No.: 11/649,248

(22) Filed: Jan. 4, 2007

(65) Prior Publication Data

US 2008/0163652 A1 Jul. 10, 2008

(51) Int. Cl.
*E05B 67/36* (2006.01)

(52) U.S. Cl. ..... 70/34; 70/181; 70/345

(58) Field of Classification Search ..... 102/221, 102/222, 254, 256, 258, 260; 70/34, 181–184, 70/345, 387, 389, 393, 417, 449, 453–454, 70/403, 404, 360, 83, 116, 117, DIG. 79; 292/57, 58

See application file for complete search history.

(56) References Cited

U.S. PATENT DOCUMENTS

| | | | | | |
|---|---|---|---|---|---|
| 2,960,037 | A | * | 11/1960 | Raech, Jr. et al. | 102/251 |
| 3,004,491 | A | * | 10/1961 | Place et al. | 102/262 |
| 3,728,936 | A | * | 4/1973 | Norris | 89/1.812 |
| 4,202,271 | A | * | 5/1980 | Day | 102/247 |
| 4,296,689 | A | * | 10/1981 | Hardesty | 102/260 |
| 4,386,568 | A | | 6/1983 | Ziemba | |
| 4,494,459 | A | | 1/1985 | Ziemba | |
| 4,712,395 | A | * | 12/1987 | Agbay | 70/34 |
| 4,967,578 | A | * | 11/1990 | Sheu et al. | 70/491 |
| 5,024,072 | A | * | 6/1991 | Lee | 70/491 |
| 5,375,525 | A | | 12/1994 | Greenslade et al. | |
| 5,693,906 | A | | 12/1997 | Van Sloun | |
| 6,386,006 | B1 | * | 5/2002 | DeWalch | 70/34 |
| 6,425,272 | B1 | * | 7/2002 | Chen | 70/34 |
| 6,543,260 | B2 | * | 4/2003 | Koy et al. | 70/34 |
| 6,619,078 | B1 | * | 9/2003 | Reese | 70/34 |
| 6,644,078 | B1 | * | 11/2003 | Hung | 70/491 |
| 6,913,413 | B2 | * | 7/2005 | Yang | 403/322.3 |
| 7,076,977 | B2 | * | 7/2006 | Lee | 70/58 |
| 7,320,285 | B1 | * | 1/2008 | Munsinger et al. | 102/229 |
| 7,377,137 | B1 | * | 5/2008 | Bednarz | 70/34 |
| 7,430,964 | B1 | * | 10/2008 | Munsinger et al. | 102/229 |
| 7,441,427 | B2 | * | 10/2008 | Vickers | 70/127 |
| 7,475,579 | B2 | * | 1/2009 | Miao | 70/496 |
| 7,574,882 | B2 | * | 8/2009 | Uliano | 70/491 |
| 2006/0112740 | A1 | * | 6/2006 | Merrem et al. | 70/58 |
| 2007/0137266 | A1 | * | 6/2007 | Hsai | 70/34 |
| 2008/0105006 | A1 | * | 5/2008 | Agbay | 70/34 |
| 2008/0163652 | A1 | * | 7/2008 | Shatskin | 70/34 |
| 2009/0145186 | A1 | * | 6/2009 | Reese | 70/380 |
| 2009/0293563 | A1 | * | 12/2009 | Jeng | 70/359 |

* cited by examiner

*Primary Examiner*—Lloyd A Gall
*Assistant Examiner*—Kristina R Fulton
(74) *Attorney, Agent, or Firm*—Robert E. Bushnell, Esq.

(57) ABSTRACT

A locking mechanism for a pyrotechnic safe and arm interrupter 98 may be constructed with an external lock casing 2, longitudinally extending bolt 3, washer 4, spring 5, retaining ring 8 and interlocking element 9 that may be configured in various shapes and features corresponding with a safety release component. A key 10 may be constructed with key stem 11, handle 12 and two pairs of teeth 13, 14 of different diameters radially protruding from successively reduced diameters along a distal portion of key stem 11. Lock 1 may be installed with notch 19 in alignment with a corresponding feature of the safe and arm interrupter mechanism and fastened in place with mounting holes 20 so that only mounting flange 17 and the key access 18 are external to the interrupter device, panel or door.

20 Claims, 17 Drawing Sheets

SAFING LOCK MECHANISM

BACKGROUND OF THE INVENTION

1. Technical Field

The present invention relates to interrupts of energy transfer lines, and more particularly, to hermetically sealed safing mechanisms for high levels of shock and vibration suitable for working with, or without, a safety release in key operated rotary locks.

2. Related Art

Detonator assemblies typically can only be initiated after a safing mechanism has been unlocked and an interlocking element of the safing mechanism is free to proceed into alignment with a diametrical bore of the detonator. The volatile nature of explosive charges used in aircraft, missiles, space vehicles and pyrotechnic systems for example, require safety features to prevent their inadvertent and hazardous initiation during maintenance of the systems; U.S. Pat. No. 3,728,936 for Arming And Safing Device issued on the 24 Apr. 1973 to Norris and U.S. Pat. No. 4,202,271 for Safe And Arm Device issued on the 13 May 1980 to Day disclose different designs for safe and arm units.

As is noted in U.S. Pat. No. 5,375,525 for Ordnance Transfer Interrupter issued on the 27 Dec. 1994 to John T. Greenslade and Donald J. Behrens, a removable safety key which can lock a safe and arm device in a safe position prior to an intended mission to ensure that output devices are not initiated, are particularly desired by customers for safe and arm security devices within pyrotechnic systems. In the even that an arm signal is sent while the particular device is locked in the safe mode, the safety key can not then be withdrawn before an arm signal is removed from the terminals of the device. Therefore, all mentioned designs are not one hundred percent safe for the key can be put in and gets locked, and can not be withdrawn only in a case of the initiated arm signal, but can be removed if the arm signal is not initiated, then there is an opportunity of not properly engaging the key initially or of moving the key during servicing with a result that the key may be removed or dislodged even after the arm signal has been initiated.

After consideration of these and other mechanisms, I discovered that contemporary locks either require a safety release that when engaged prevents the key from being removed after the mechanism is locked or otherwise fails to secure the mechanism from accidental unlocking when a safety release is not desired. Moreover, many contemporary designs of safing locks fail to provide an indication that the mechanism is in a locked mode.

The present invention is 100% save for it makes the device save just by installing the key and the key gets locked and can not be withdrawn with or without the Arm signal. This invention provides means of proving that the key is locked and device is save to work with by first manifesting an audible sound from engaged detents and second the Key can not be taken out when properly engaged until the over-Save signal is initiated from an external source.

SUMMARY OF THE INVENTION

It is therefore, one object to the present invention to provide an improved lock controlling interrupts of energy transfer lines.

It is another object to provide a lock able to control interrupts of energy transfer times with one hundred percent safety.

It is still another object to provide a hermetically sealed lock mechanism amenable to exposure of high levels of shock and vibration.

It is yet another object to provide a hermetically sealed mechanism able to function at high levels of shock and vibration with, or without, a safety release.

It is still yet another object to provide a lock able to control interrupts of energy transfer lines while preventing an engaged key from being removed after the mechanism is locked by that key.

It is a further object to provide a lock able to control interrupts of energy transfer lines while restricting the internal release and removal of an engaged key from the lock while the mechanism is in a locked state to an external mechanical, electrical or optical intervention.

It is a yet further object to provide a lock able to control interrupts of energy transfer lines that issues an audible feedback when the mechanism is locked and that secures the mechanism against accidental unlocking when a safety release is not desired.

These and other objects may be attained with a key operated rotary locking mechanism able to control interrupts of energy transfer lines regulated by an safe and arm device, even in an environment subjected to high levels of shock and vibration. Both the lock and key combine to form a hermetically sealed mechanism able to function with, or without, a safety release that prevents the key from being removed from the safe and arm mechanism after the mechanism has been locked by that key following a sequence of axial and rotational movements, and that releases the key internally only in response to externally applied mechanical, electrical or optical influence. A detent of the lock mechanism provides audible feedback when the mechanism is locked and secures mechanism from accidental unlocking when a safety release is not desired.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
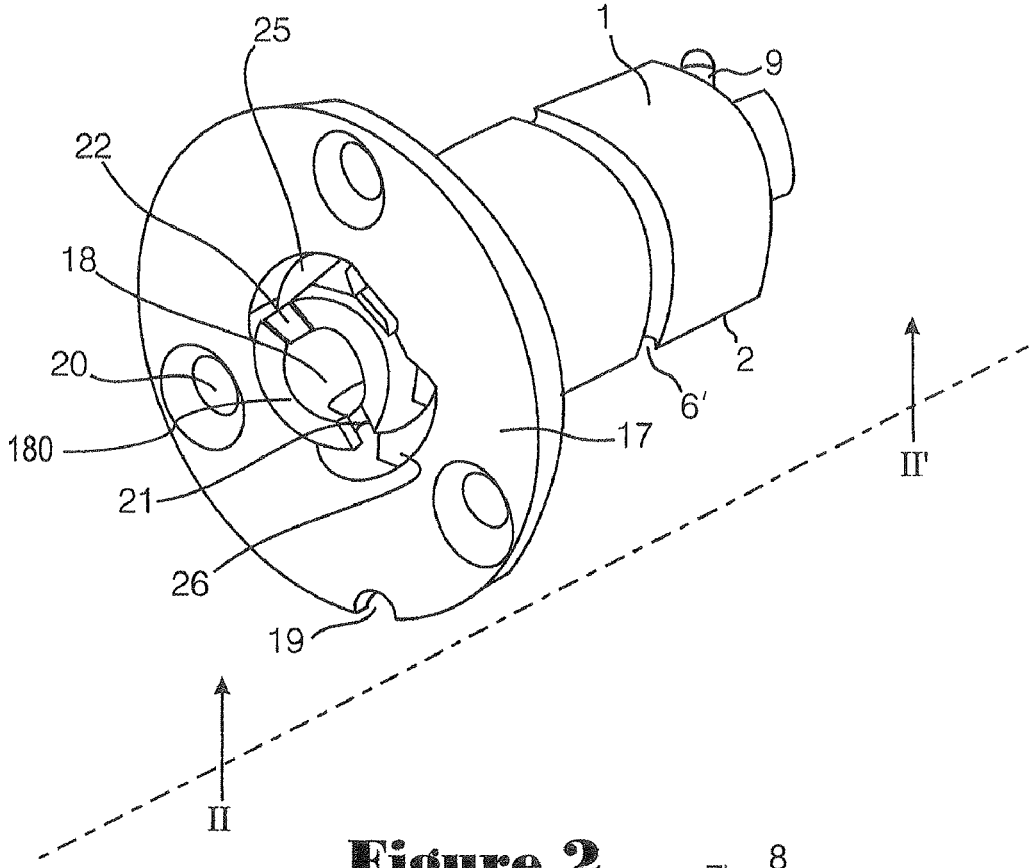
FIG. 1 is an orthogonal projection view of an embodiment constructed according to the principles of the present invention.
Figure 2:
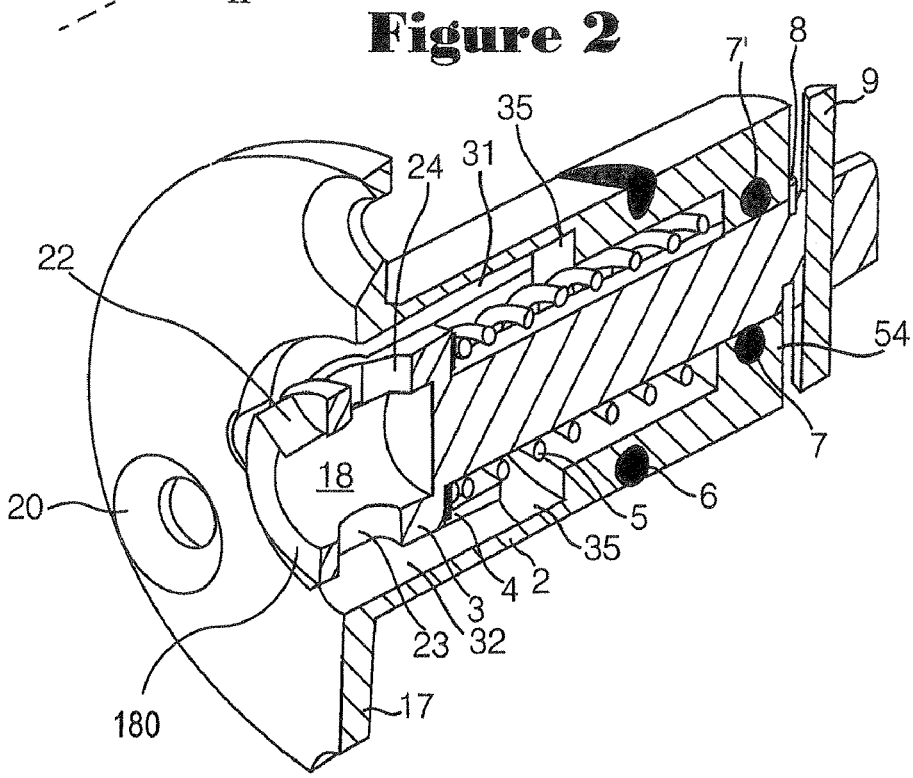
FIG. 2 is a cross-sectional view of the embodiment of FIG. 1 taken along sectional line II-II'.
Figure 3:
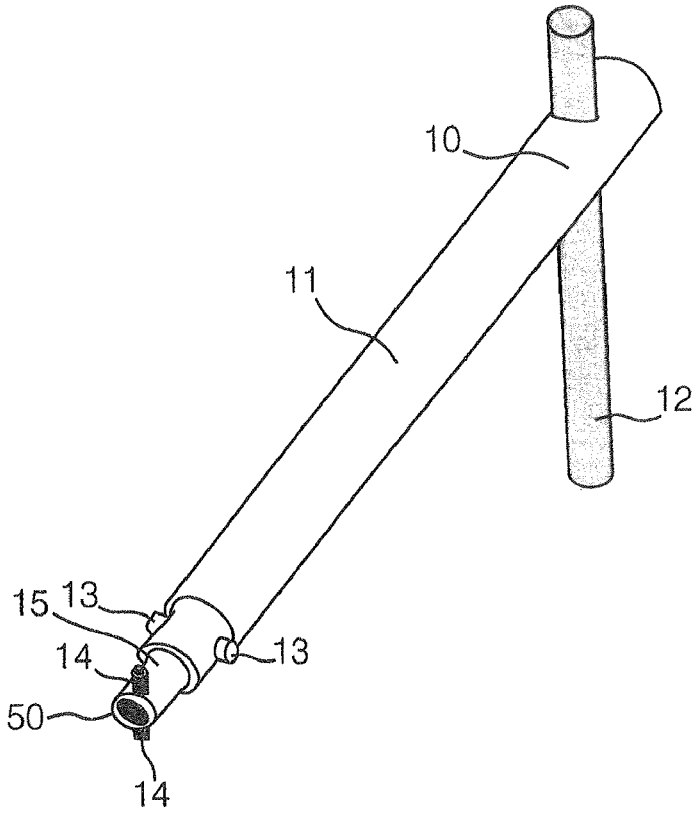
FIG. 3 is an orthogonal projection view of a key amenable for cooperative use with the embodiment of FIG. 1.
Figure 4:
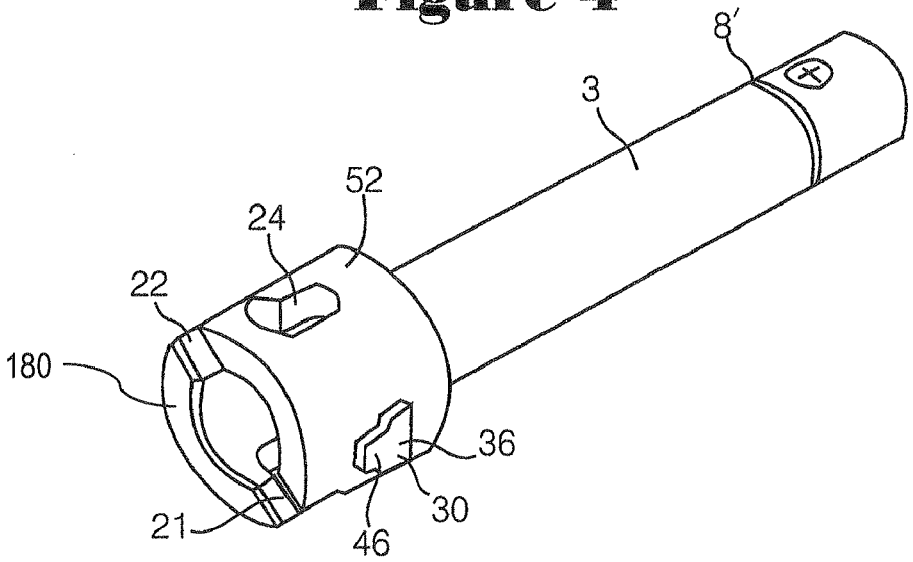
FIG. 4 is an orthogonal projection view of the bolt incorporated into the embodiment illustrated by FIG. 1.
Figure 5:
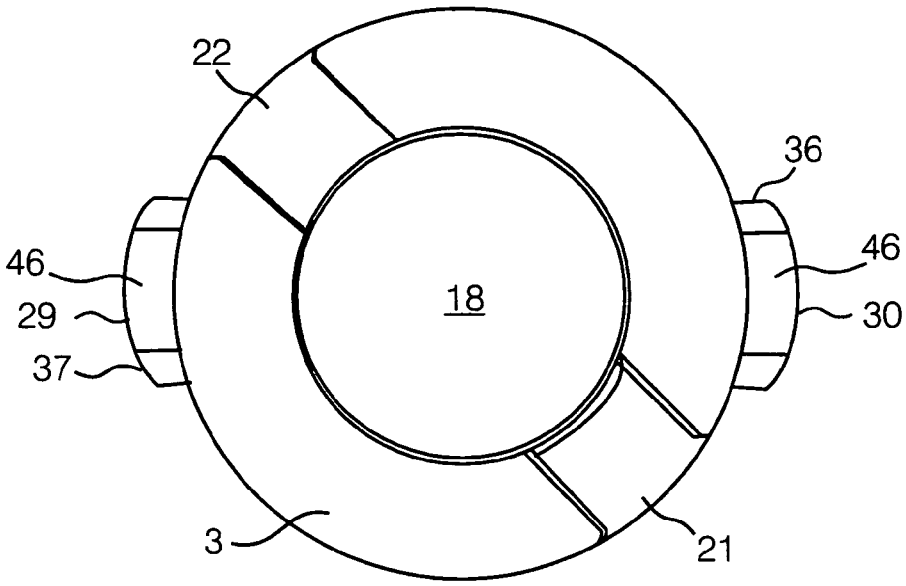
FIG. 5 is a front elevation view of the bolt illustrated by FIG. 4.

Turning now to the drawings, FIGS. 1, 2 and 3 collectively illustrate a locking mechanism 1 for a pyrotechnic safing interrupter, that may be constructed with an external lock casing 2, longitudinally extending bolt 3, washer 4, spring 5, retaining ring 8 and interlocking element 9 that may be configured in various shapes and features corresponding with a safety release component. Element 9, although shown as a member radially extending transversely across the distal end of bolt 3, is an exemplar representative of different structural shapes that are oriented by casing 2 to engage and to be operationally restrained by an arming device of lock a safe and arm mechanism in a safe position prior to an intended mission to ensure that output devices secured by lock 1 will not be initiated; consequently, when element 9 is restrained by the arming device, key 10 cannot be rotated and may not therefore, be removed from bolt 3 until the arming device is activated to release element 9. Key access 18 is surrounded by key port 180, and key access 18 receives key 10. This configuration assures the reliability of safe and arm security mechanism fitted to control the status and use of live pyrotechnic systems.

A key 10 may be constructed with key stem 11, handle 12 and two pairs of teeth 13, 14 of different diameters radially protruding from successively reduced diameters along a distal portion of key stem 11. Lock 1 may be installed with notch 19 in alignment with a corresponding feature of a safing interrupter and fastened in place with mounting holes 20 so that only mounting flange 17 and the key access 18 are external to the interrupter device, panel or door.

Lock 1 may be hermetically sealed by external elastomeric O-ring 6 borne by circumferential groove 6' and internal elastomeric O-ring 7 borne by circumferential groove 7'. O-ring 7 should be greased in order to minimize the amount of force required to be applied along the axial direction of key stem 11 during manipulation of key 10. Details for a safety release portion may be any part or assembly of a safing interrupter (as soon as it is decoupled from the lock mechanism; and except parts sensitive to high forces while trying to break the key free when it is locked like motor shaft) that is configured with features that operatively match an interlocking element such as radial pin 9 carried by the distal portion of bolt 3, and are described in greater detail in the later discussion of FIGS. 19, 20 and 21.

Turning now to FIGS. 4, 5, 6, 7, 8, 9, 10, 11, and 19, in conjunction with FIGS. 1, 2 and 3, when lock 1 is installed in safe and arm mechanism 98, threaded fasteners 108 extend through countersunk holes 20 to secure flange 17 against an exposed surface of mechanism 98. In order to place lock 1 in its locked mode, distal end 50 of key 10 is manually placed in coaxial alignment with key access 18 with front teeth 14, 14 respectively aligned with receiving slots 21, 22 of bolt 3. The receiving slots 21, 22 may serve as a key retainer which may preserve the geometric alignment between a key that had been fully inserted into the key access and that key access by preventing the key from becoming partially separated from the key access. No application of force is necessary, when key 10 is pushed axially inwardly against bolt 3 and rotated clockwise concurrently, front teeth 14, 14 travel along slots 21, 22 and into slots 23, 24.

Figure 19:
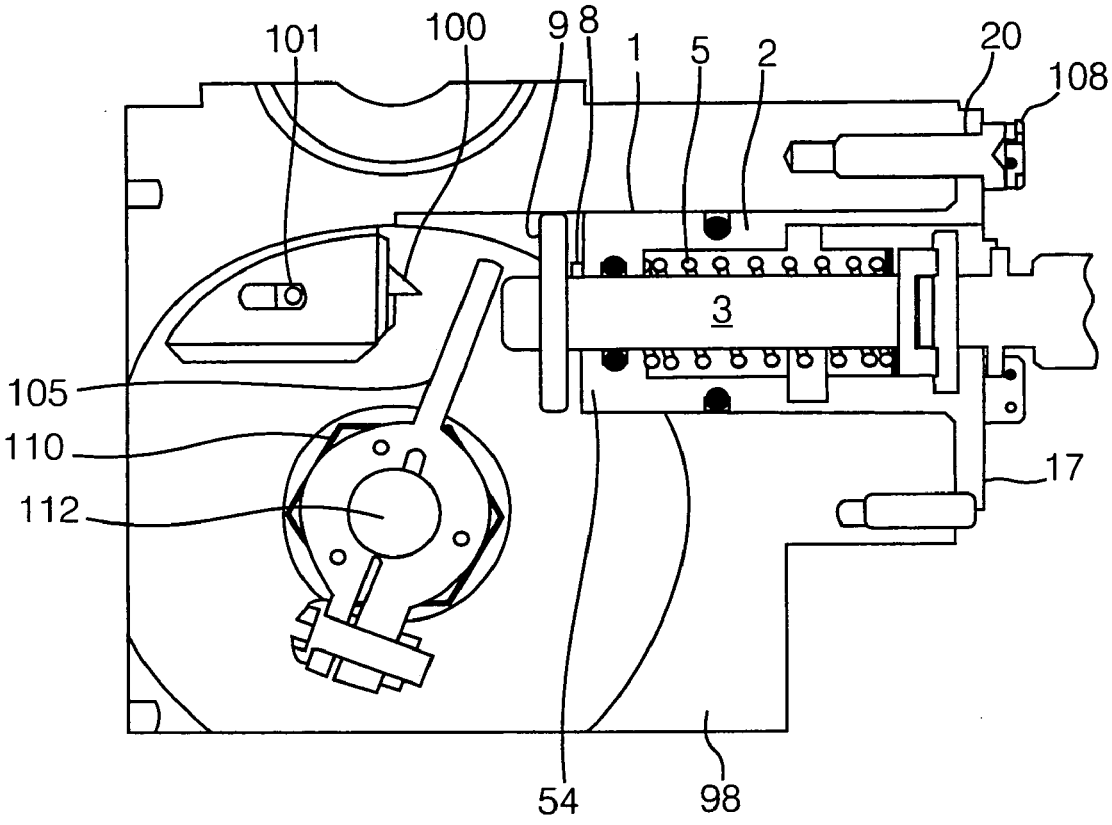
FIG. 19 is a cross-sectional view showing a lock installed in an safe and arm mechanism while in an armed mode.

FIG. 19 provides a cross-sectional view of lock 1 in its initial position with teeth 14 of key 10 installed slots 23, 24. Flag 105, which is a visible indicator of the armed or safe operational modes of safe and arm mechanism 98, is its rightmost position to visually signal that safe and arm mechanism 98 is in its armed mode. Flag 105 is connected to a shaft 112 of safe and arm mechanism 98 via a clevis secured by threaded fastener 110. In the position shown by FIG. 19, interlocking element 9 is free, and is not engaged, or otherwise restrained, by spring loaded latch 100; key 10 may therefore be withdrawn from bolt 3 without altering the operational mode of safe and arm device 98.

Figure 12:
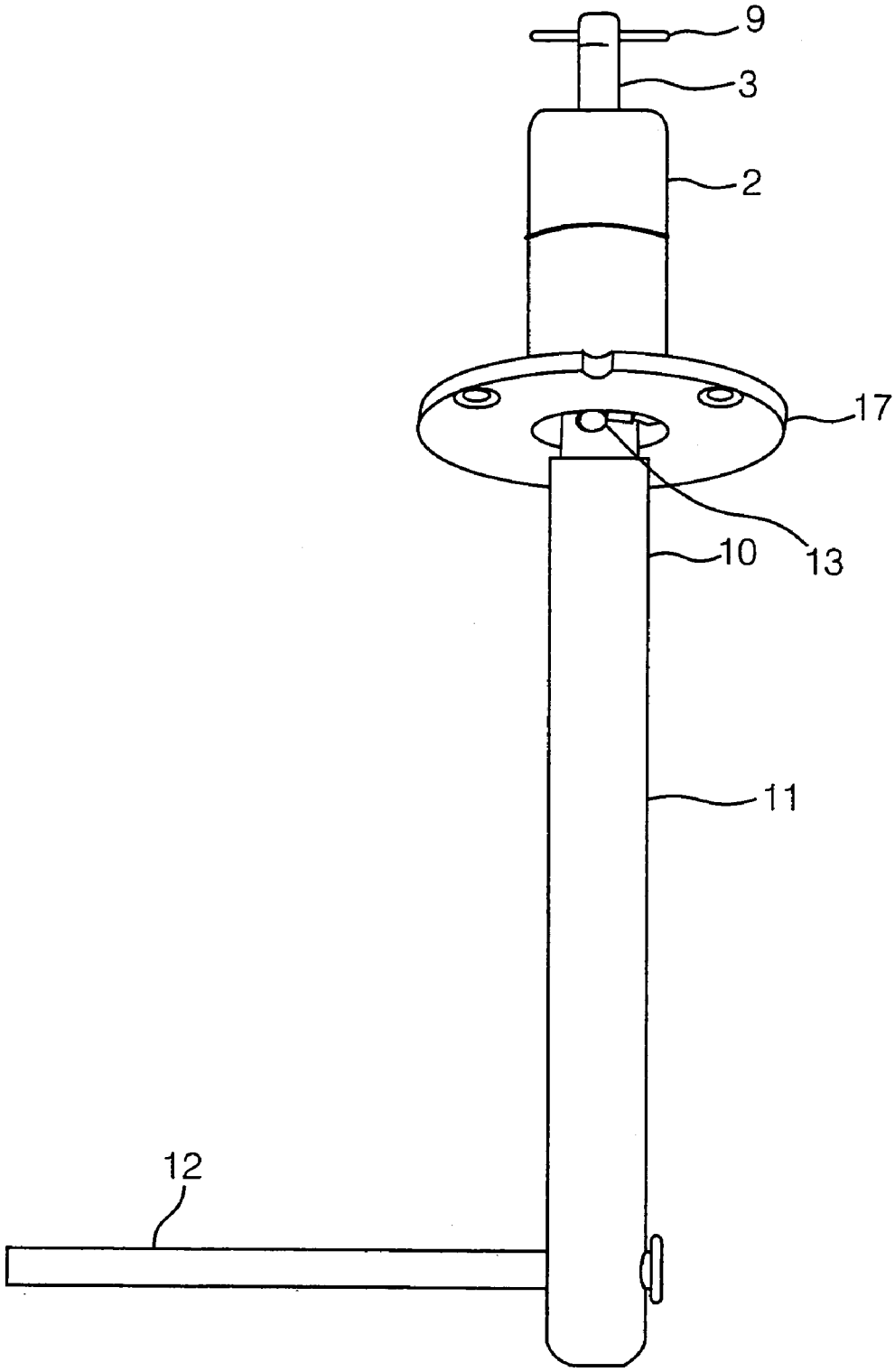
FIG. 12 in an oblique view illustrating a key fully engaging a lock.
Figure 13:
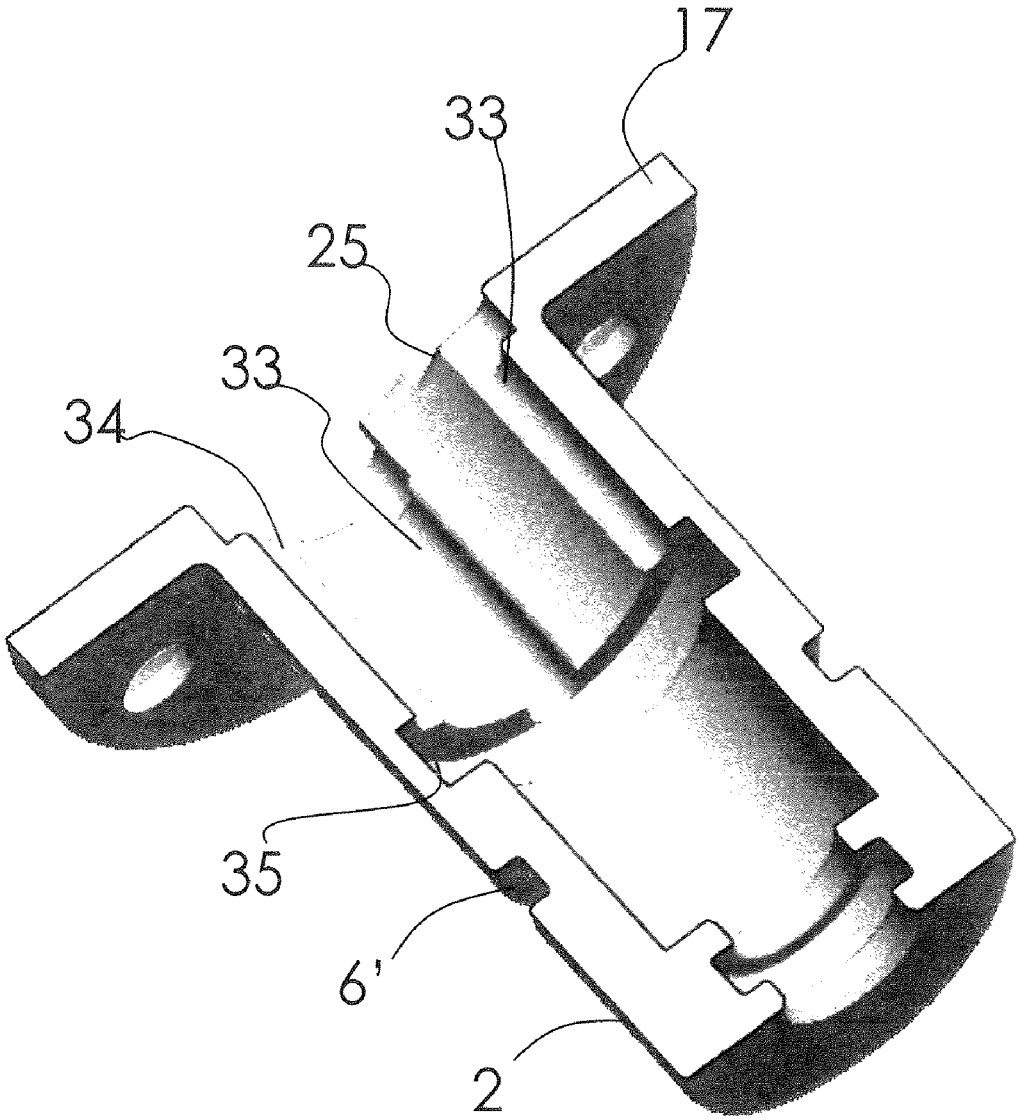
FIG. 13 is an oblique cross-sectional view of the lock casing.
Figure 14:
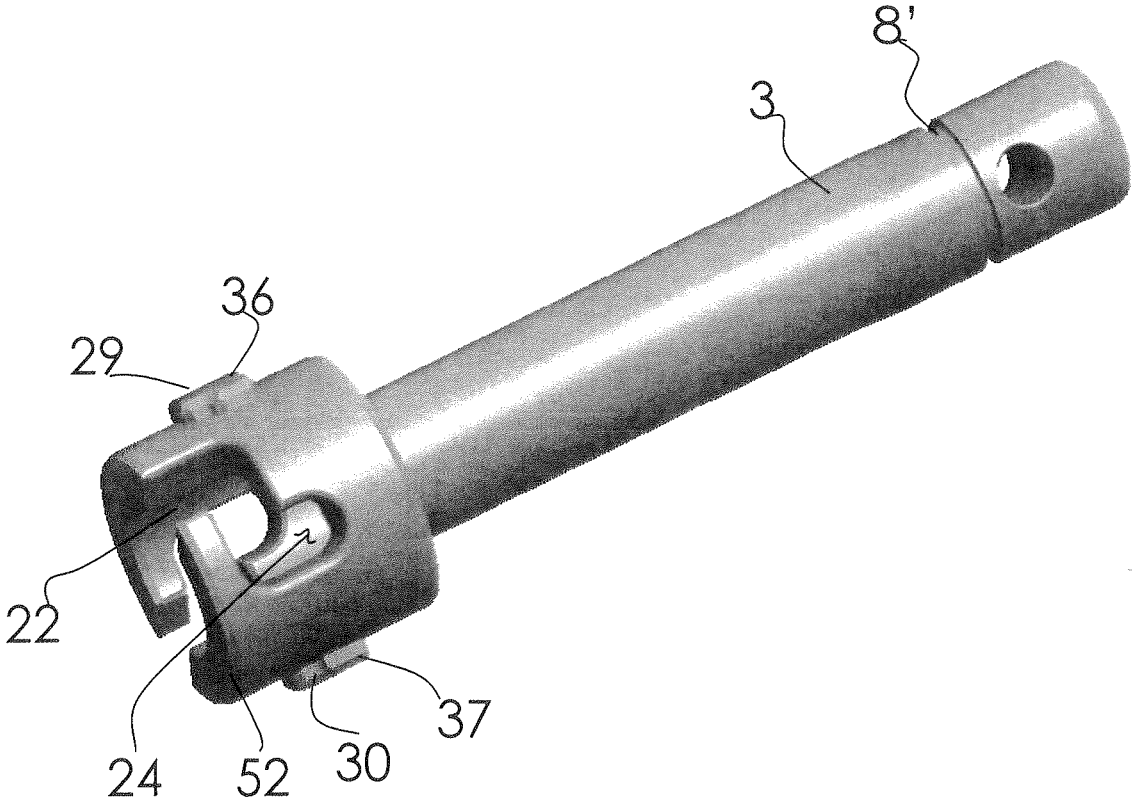
FIG. 14 is an oblique view of the bolt.
Figure 15:
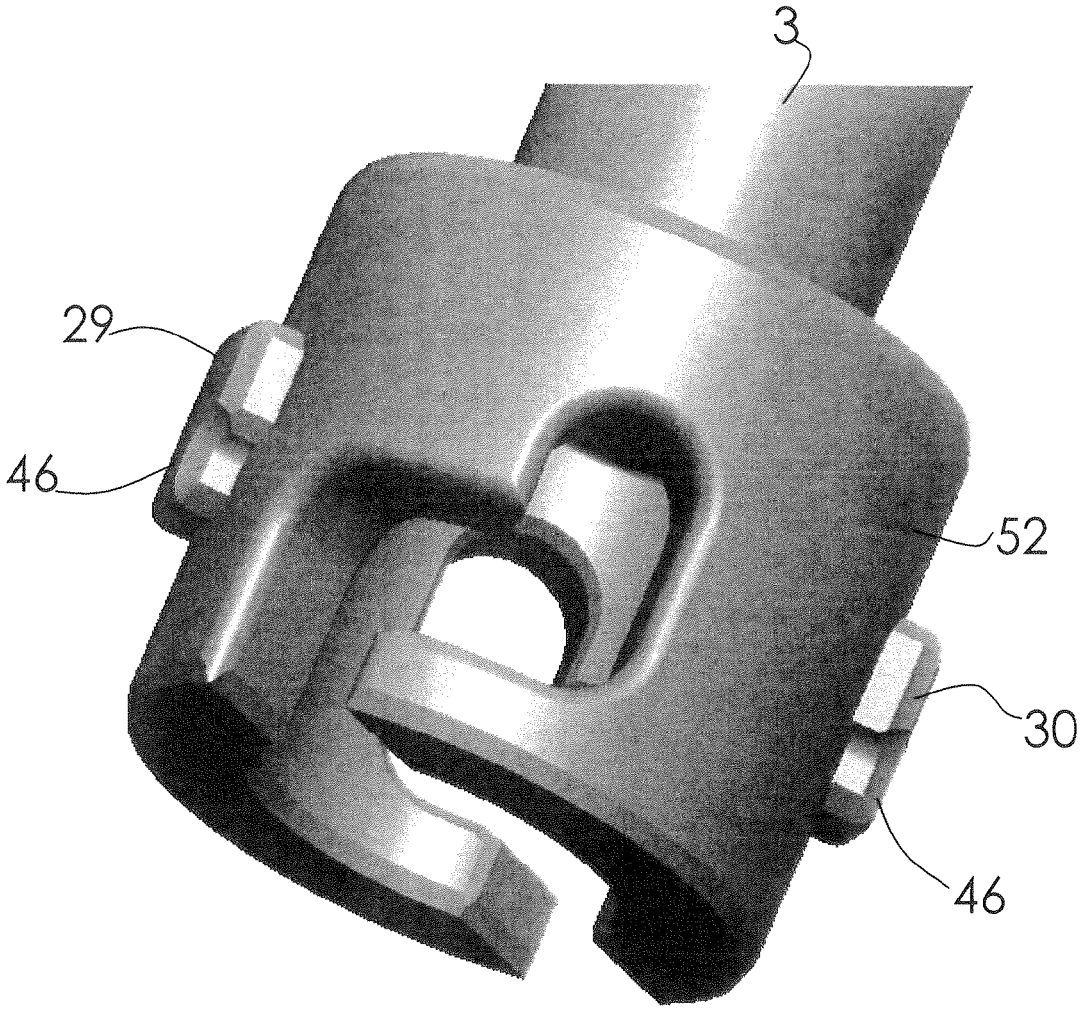
FIG. 15 is an oblique view of a proximal end of the bolt.
Figure 16:
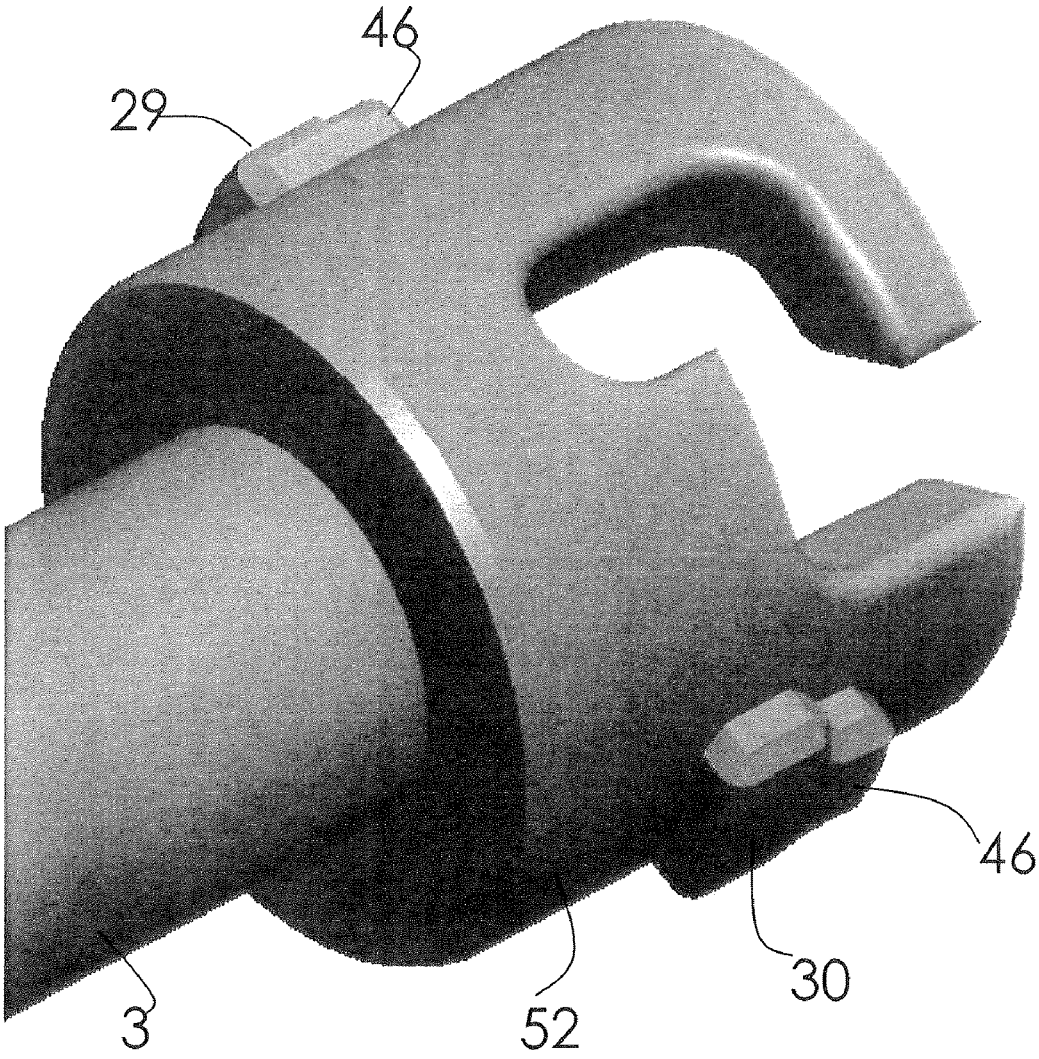
FIG. 16 is an enlarged side view of the proximal end of the bolt.
Figure 17:
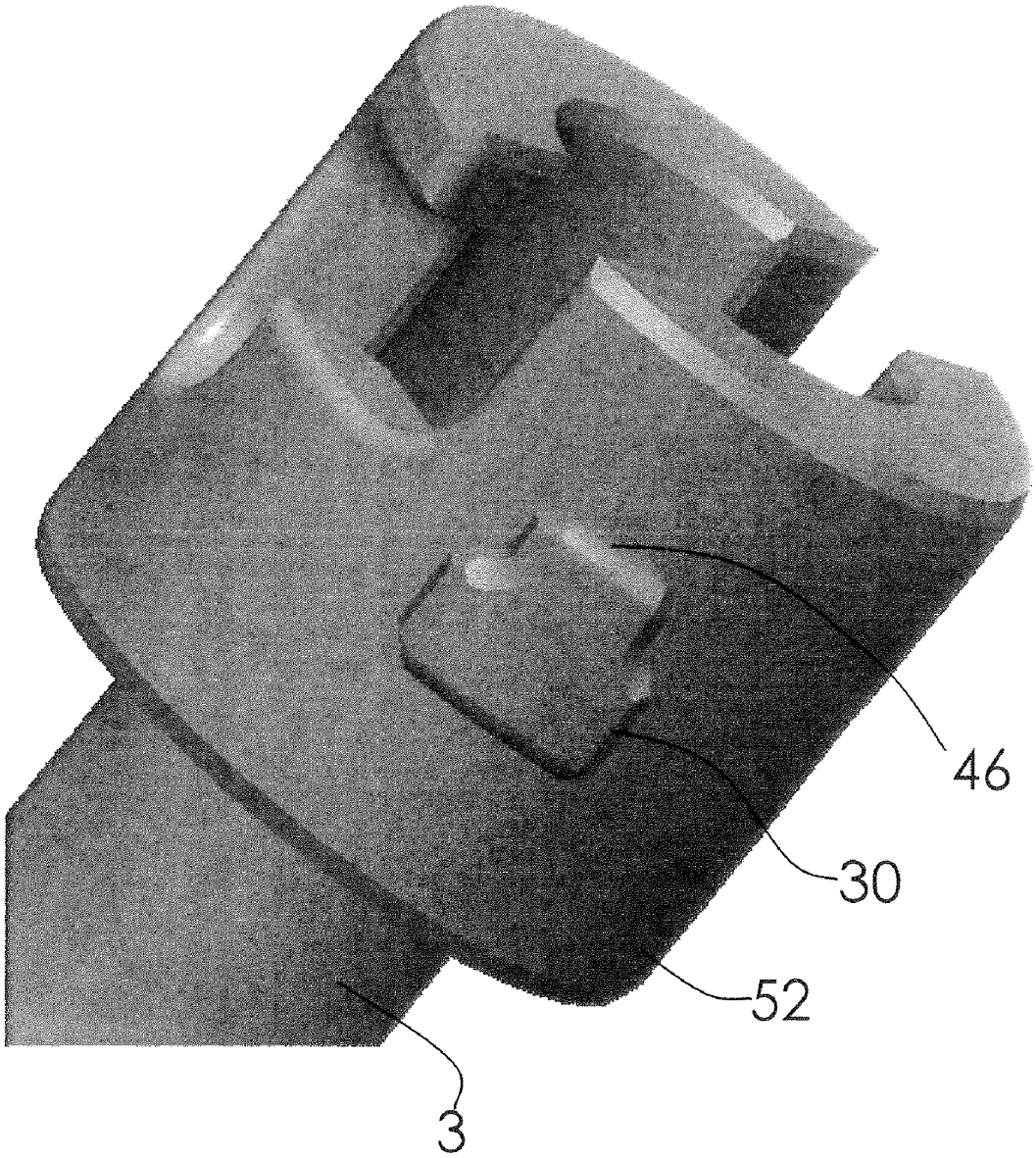
FIG. 17 is an enlarged side view showing a detent borne by the proximal end of the bolt.
Figure 18:
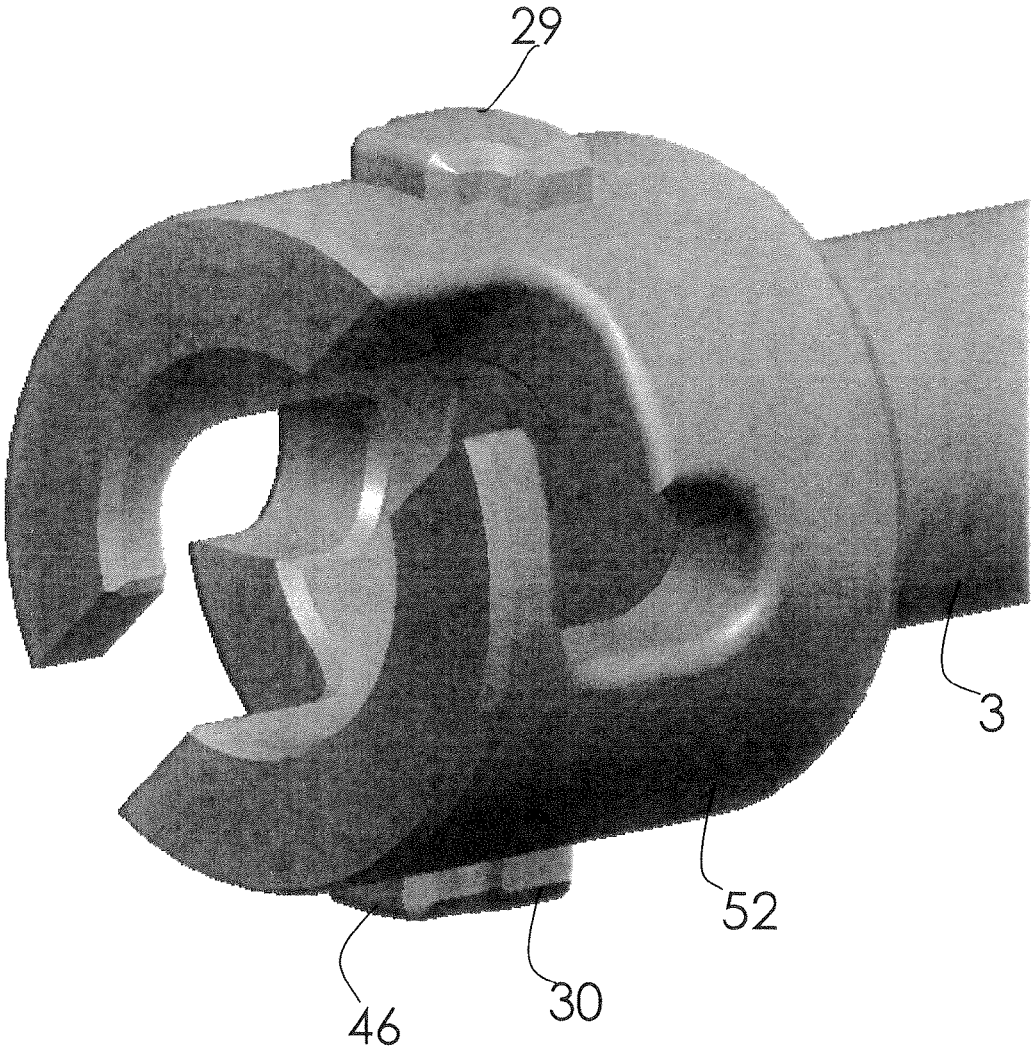
FIG. 18 is a different enlarged side view showing both detents borne by the proximal end of the bolt.

FIG. 12 shows the distal portion of key 10 seated within lock casing 2. Only when the teeth 14, 14 rest within slots 23, 24 touching the semi-round surfaces of slots 23, 24 the force along the axial direction to stem 11 of key 10 should be deliberately applied in order to overcome the compression force of spring 5. At this point the force applied along the axial direction of stem 11 is transferred to bolt 3 through teeth 14.

Continued application of axial force to key 10 concurrently axially moves key 10 and bolt 3 as a single entity axially forward against the force of spring 5; during this movement teeth 14, 14 tangential points of the circumferential surfaces are in contact with side walls of grooves 31, 32 and detents' 29, 30 wider bodies 36, 37 side surfaces are in contact with side walls of grooves 33, 34. Both pairs of grooves 31, 32 and 33, 34 function as alternate guides for teeth 14, 14 and detents 29, 30 until detents 29, 30 drop into circumferential chamber 35 where both 14, 14 and detents 29, 30 can freely rotate; and at the same time back teeth 13 of key 10 touch the exposed surfaces of recessed radial segments 25, 26 of lock casing 2. Continued application of axial force to key 10 axially is needless and should be discontinued because key 10 and bolt 3 when joined in tandem as a single entity have only a single degree of freedom left—rotational.

Figure 6:
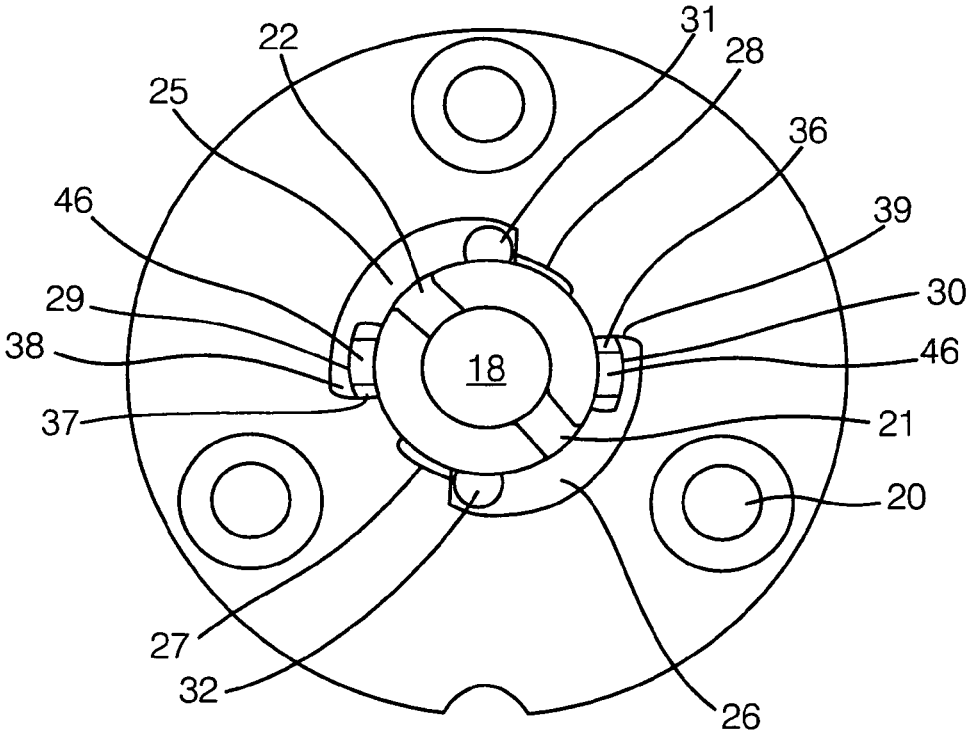
FIG. 6 is a front elevation view of the embodiment illustrated by FIG. 1.
Figure 7:
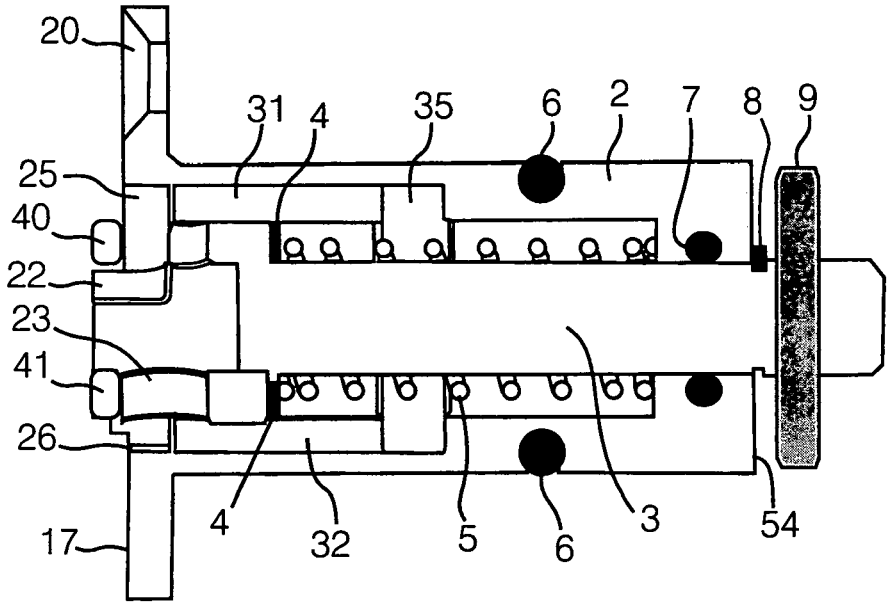
FIG. 7 is a side elevation, cross-sectional view of the embodiment of FIG. 1 taken along sectional line II-II'.
Figure 8:
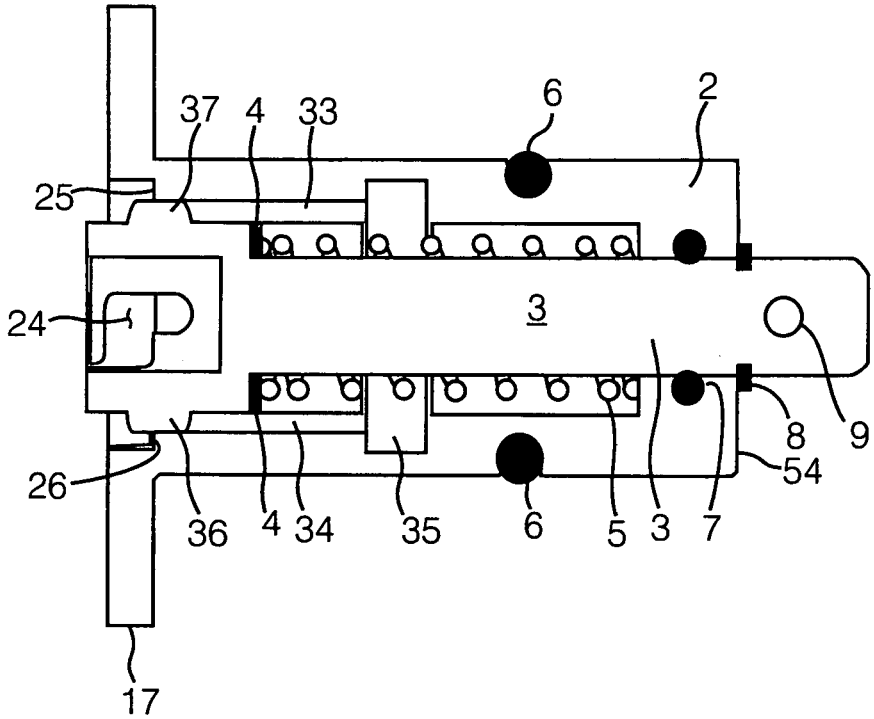
FIG. 8 is a plan, cross-sectional view of the embodiment of FIG. 1, taken along a perpendicular plane to sectional line II-II'.
Figure 9:
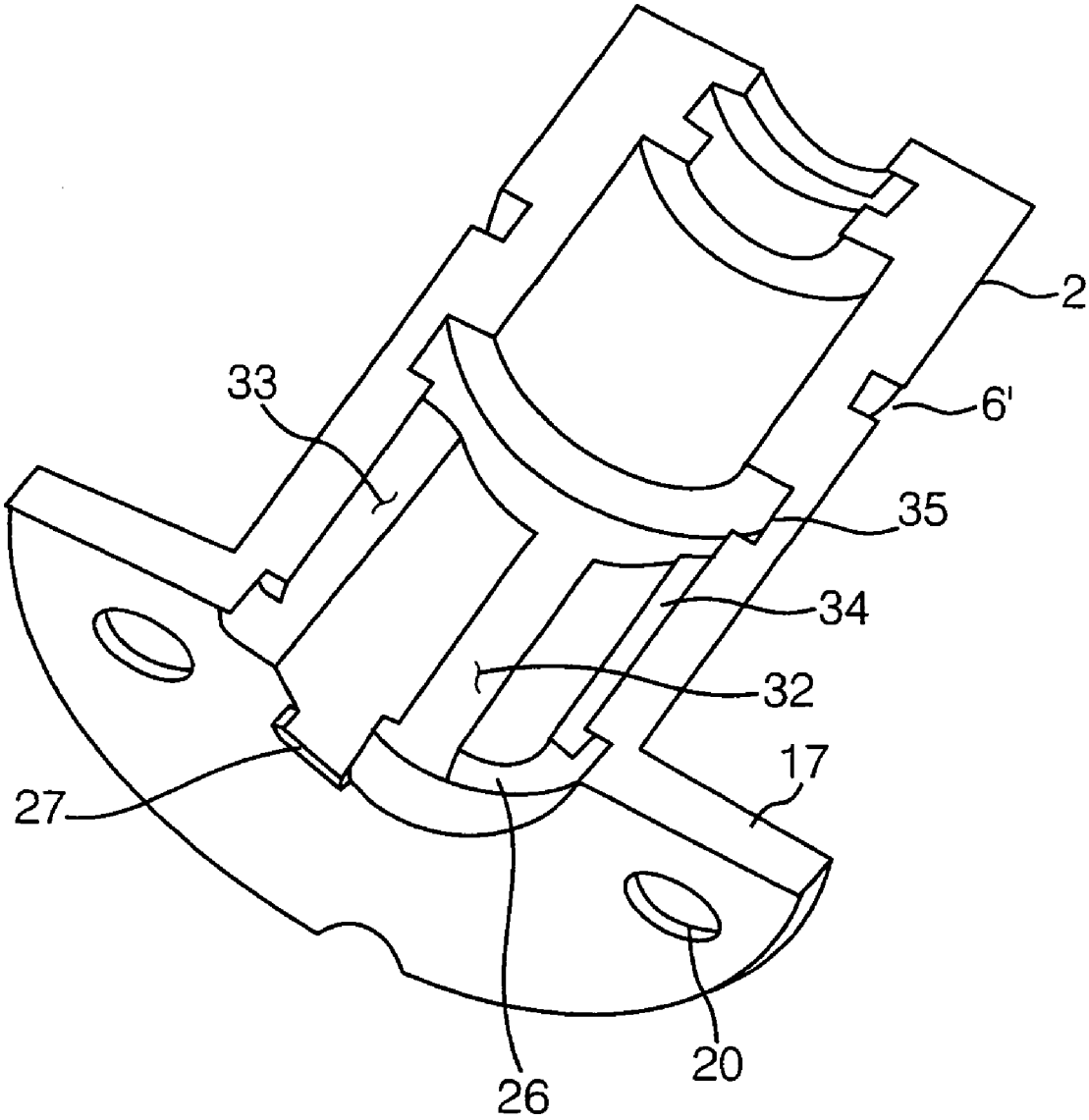
FIG. 9 is a cross-sectional view of the lock casing illustrated by FIG. 1, taken from one orientation.
Figure 10:
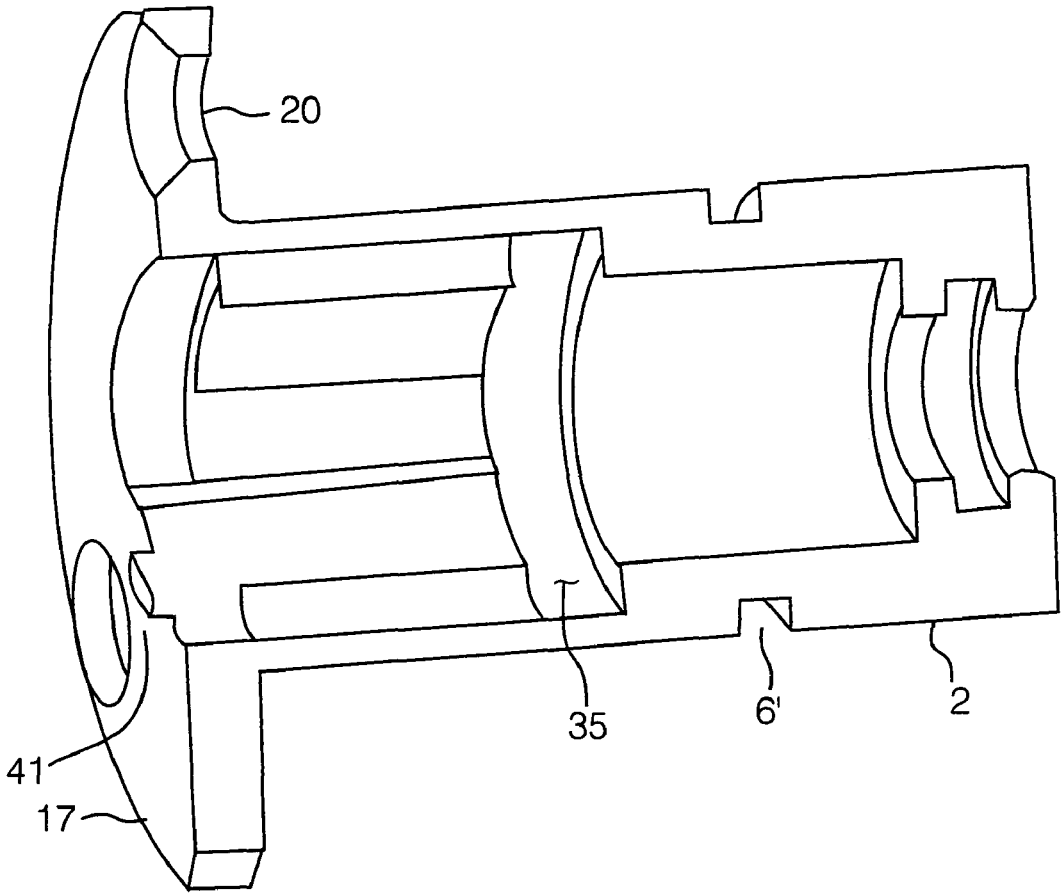
FIG. 10 is a cross-sectional view of the lock casing illustrated by FIG. 1, taken from a different orientation than the view of FIG. 9.
Figure 11:
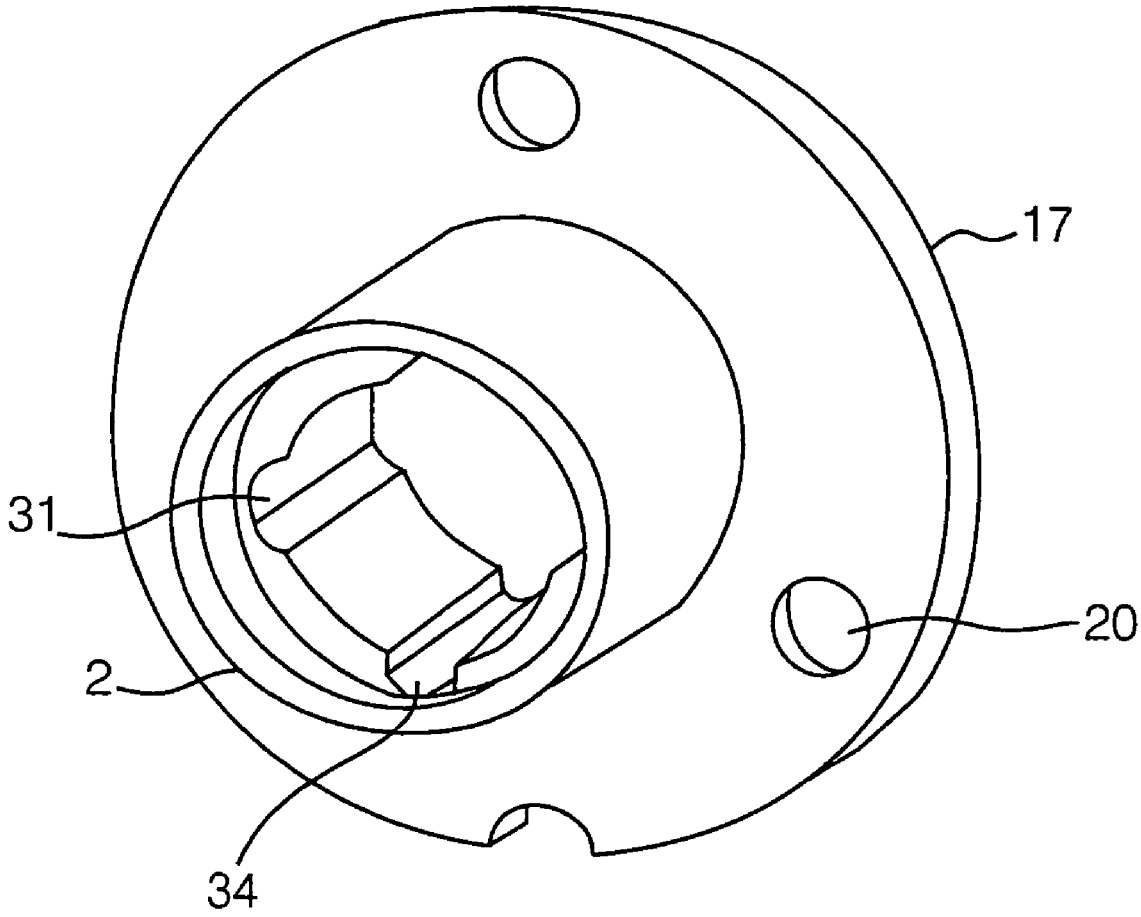
FIG. 11 is an oblique view illustrating the bore of the lock casing illustrated by FIG. 1.

Turning now to FIG. 6, resumption of clockwise rotation of key stem 11 enables simultaneous rotation of front teeth 14, 14 and detents 29, 30 in chamber 35; and allows back teeth 13, 13 to glide along the exposed surfaces of recessed radial segments 25, 26 until clockwise rotation of back teeth 13, 13 is blocked by edges 27, 28. At this point in time rotation stops such that teeth 14, 14 and detents 29, 30 are aligned with opposite grooves. It is essential to remember that the cross-section of the two pairs of grooves of lock casing 2 parallel to the front elevation view FIG. 6 are different because the cross-section of grooves 31, 32 is taller and narrower than grooves 33, 34. FIG. 12 illustrates the tandem combination of key 10 with lock 2, which forces pin 9 carried by the distal portion of bolt 3, to extend axially outwardly from the distal end of lock casing 2.

Release of the axial force from key stem 11 before rotation leaves only the single axial force from spring 5 applied axially outwardly through washer 4 to the tandem structure of bolt 3 and key 10, thereby forcing "T-legs" 46, 46 of detents 29, 30 (that is, the individual legs 46, 46 of tee-shaped detents 29, 30) which protrude radially outwardly from the circumferential surface of proximal end 52 of bolt 3, to slide along axially extending flutes 31, 32, from the chamber 35 outward. The wider features 36, 37 of detents 29, 30 will remain in chamber 35 and stop bolt 3 and key 10 from farther outwardly axial movement because channels 31, 32 even thought taller, are narrower than channels 33, 34. Chamber 35 is a common area where two pairs of grooves, or flutes 31, 32 and 33, 34 meet and where teeth 14, 14 and detents 29, 30 circulate after axial movement of key 10 and bolt 3 is exhausted, thereby placing the mechanism in its locked mode with key 10 retained inside key access 18. In this configuration, spring 5 is held in a compressed state illustrated by FIG. 20.

Figure 20:
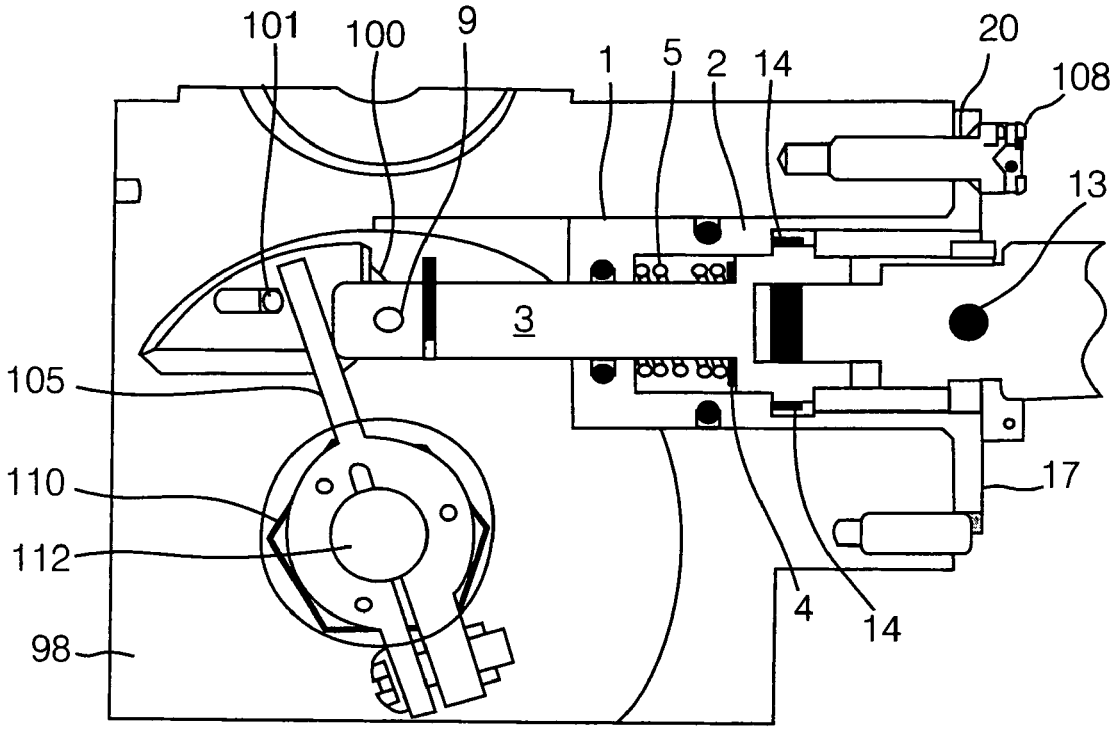
FIG. 20 is a cross-sectional view showing a lock installed in an safe and arm mechanism while in a safe mode.
Figure 21:
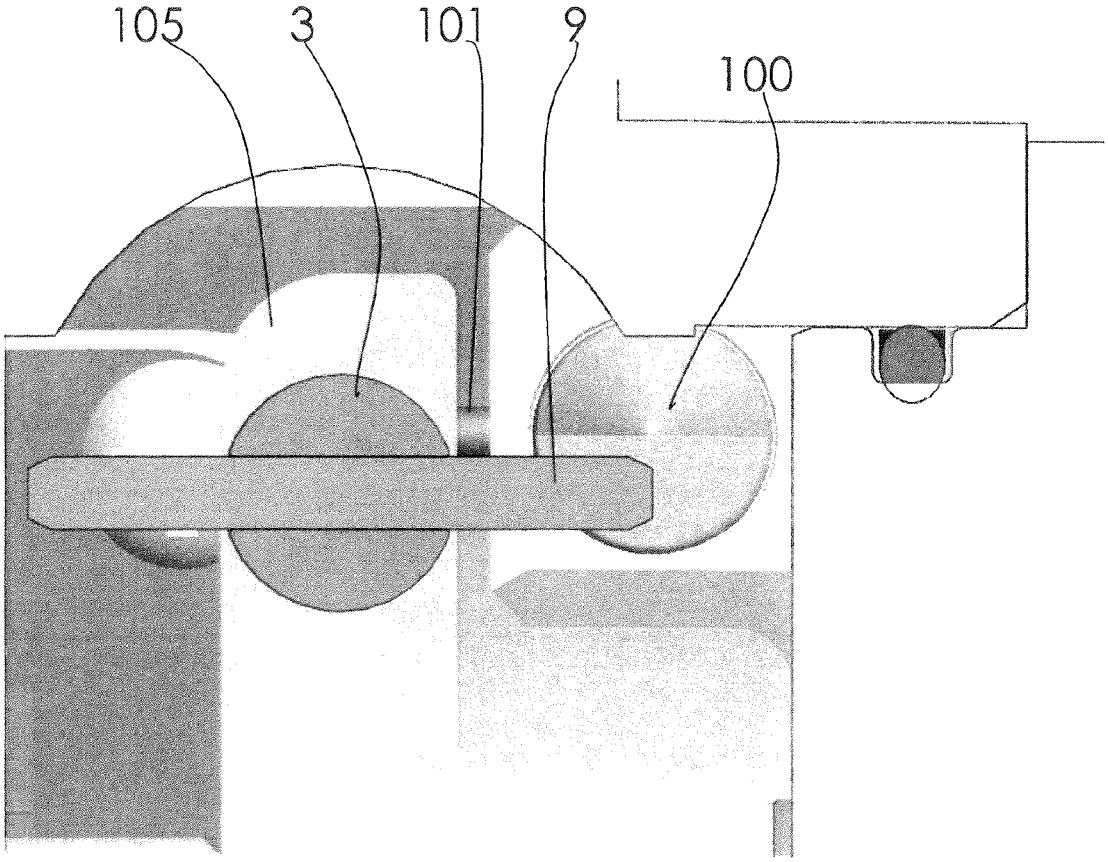
FIG. 21 is a cross-sectional view showing the spatial relation between the bolt of a lock and a flag that provides a readily visual indication of the operation mode of an safe and arm mechanism.

FIG. 20 shows lock 1 fully engaged after bolt 3 has been moved axially forward and rotated by ninety (90°) degrees, while FIG. 21 shows the spatial relation between interlocking element 9, spring loaded latch 100, safe position push pin 101, and visual flag 105. During engagement, bolt 3 pushes flag 105, which is connected to shaft 112 of safe and arm mechanism 98 via a clevis secured by threaded fastener 110; consequently, bolt 3 forces shaft 12 to rotate in a counter-clockwise direction, which places safe and arm mechanism 98 in a safe mode of operation. Interlocking element has engaged, and is restrained by spring loaded latch 100; consequently, interlocking element 9 may not be moved from the position shown in FIG. 20 until after spring loaded latch 100 is retracted.

Latch 100 can be retracted by employing a resetting mechanism such as an electrical solenoid, or an optical or mechanical driver, to rotate flag 105 and shaft 112 counter-clockwise. When rotated counter-clockwise, flag 105 will move from the safe operational mode shown in FIG. 20 over push pin 101 which is attached to latch 100. Latch 100 will then retract and allow interlocking element 9 to be rotated under the influence of rotational torque manually applied to the proximal end of key 10, ultimately enabling key 10 to pull bolt 3 into its initial position shown by FIG. 19.

Once spring loaded latch 100 is manipulated to release interlocking element 9 from the restrained position shown in FIG. 20, in order to release the mechanism of lock 1 from its locked mode, key 10 is pushed axially inwardly against bolt 3 and the force of spring 5, thereby enabling detents 29, 30 to move axially inwardly from grooves 31, 32 and into chamber 35 which extends in diametric opposition from the longitudinal axis of bolt 3.

Subsequent rotation of bolt 3 in a counter-clockwise direction enable teeth 14, 14 to rotate circumferentially along chamber 35 while teeth 13, 13 slide circularly upon surfaces 25, 26 of recessed radial segments of lock casing 2, and until teeth 13, 13 return to their original positions where the rotational motion is stopped by edges 38, 39 illustrated in FIG. 6. Upon release of key 10 from axial and rotational forces, the force from partially compressed spring 5 is released to drive bolt 3 axially outwardly toward mounting flange 17 until retainer ring 8 engages the axially opposite base 54 of lock casing 2, as shown by FIG. 19.

Key 10 may then be pulled in a direction axially away from key access 18 and turned slightly in a counter-clockwise direction in a single motion, and subsequently removed. In order to pull bolt 3 out from the bore of casing 2, hook-shapes of bosses 40, 41 which extend axially outwardly beyond the exposed surface of mounting flange 17, from the proximal end of bolt 3 enable front teeth 14, 14 to engage bosses 40, 41 and withdraw bolt 3 from the cylindrical axial bore of casing 2. The force of compression of spring 5 may not be enough to push bolt 3 and key 10 out from the bore of casing 2 after the rotation "hook" type bosses 40, 41 are in the way of teeth 14, 14 on their way out so that the force supplied by the operator to key 10 is transferred to bolt 3. Once key 10 has been removed from key access 18, lock 1 in its unlocked mode.

Lock 1 and key 10 can work in independent or in contingent modes, depending upon the latching features employed within safe and arm mechanism 98 to restrain interlocking element 9 of bolt 3, and the corresponding engaging part of safe and arm device 98 that retains bolt 3 and key 10 together in tandem at the end of the stroke and rotation by key 10.

In an independent mode of operation, key 10 locks and unlocks the mechanism and may be manually withdrawn from lock 1.

In the contingent mode of operation, key 10 after locking the mechanism, is retentively retained within key access 18 and may neither unlock the mechanism nor be removed unless a safety release 100 shown by FIGS. 19, 20 and 21, is intentionally activated from an independent source by either mechanical action, or by an electrical or an optical signal that causes a disengagement of interlocked parts of bolt 3 and key 10. Alternatively, locking features of key 10 or the safety release may be designed to break off under application of a specific force or torque applied to the key 10. One of the applications for safe and arm mechanism 98 when equipped with an external unlocking assembly, may be that key 10 can not be removed from lock 1 when safe and arm mechanism 98 is switched from the armed mode (as shown by FIG. 19) and into the safe mode of operation (as shown by FIG. 20).

The foregoing paragraphs describe the enhancement brought by embodiments of a safing lock constructed according to the principles of the present invention, to enhance the assurance of interrupts in energy transfer lines, by providing hermetically sealed mechanisms designed to withstand high levels of shock and vibration, and which are suitable for working either with or without a safety release. The principles of the invention may be practiced with other features; by way of example, casing 2, bolt 3, washer 4, spring 5, retaining ring 8 and interlocking element 9 may have various shapes and features in order to conform with the structure of a safety release, if an embodiment is constructed to incorporate a safety release.

Casing 2 has two pairs of internal grooves (which may be either straight or helical in their axial lengths) with different widths and radial heights that provide a precision fit for front teeth 14, 14 and the two radially projecting detents 29, 30; together, these features render lock 1 a foolproof assembly of lock casing 2 and bolt 3, with one combination only for bolt and key removal. The wider grooves are shorter and the angle between two different adjacent grooves connected by a recessed radial segment determines a specific angular rotation of the lock from the angular rotation range. In the design shown in FIGS. 6, 7 and 8, the angle of rotation is shown as 90°. All grooves terminate in chamber 35, which allows rotation of front teeth 14 and radially protruding detents 29, 30.

Key 10 is equipped with two pairs of teeth 13, 13 and 14, 14 of different diameters; both teeth in each pair are coaxial and front pair 14, 14 is smaller in diameter. Key 10's back and front teeth 13, 13 and 14, 14, respectively, are spaced axially apart and positioned at a particular angle in relation to each other, depending on the axial travel desired for bolt 3; the angle of rotation of bolt 3 will be equal to that particular angle. The choice of that particular angle of rotation varies on the basis of the design of grooves 31, 32 and 33, 34 inside the bore of lock casing 2, and is limited for straight flutes to a range of between approximately 20° to approximately 160°, depending on the diameters of front teeth 14, 14 and back teeth 13, 13 that establish the width of each adjacent pair of grooves 31, 32 or 33, 34 that can be physically machined side by side. In this design shown in FIG. 3, the particular rotation of angle can vary from around approximately 40° to approximately 140° based on the diameters of teeth 13, 13 and 14, 14, and may be set to chosen 900. The choice of particular angle/angle of rotation for lock casing 2 grooves with helical flutes varies from between 0° to 180° for machined limitations can be offset by helical angle grooves 31, 33 or 32, 34.

Internal guide grooves 31, 32, 33, 34 may be machined as spiral flutes which necessitate helical travel (not shown) by teeth 14, 14 and detents 29, 30 that make the first step in a two-step sequence an amalgamation of continuous axial and rotational transition that widens the choices of angle of rotation to choose from by counting in a helical angle of right or left hand helices.

Bolt 3 has interlocking features or elements at its end; in this embodiment, interlocking element 9 is a dowel pin pressed through the distal end of bolt 3. Two hook-type bosses 40, 41 protrude from the front, or proximal end of bolt 3, and two T-shaped detents 29, 30 are disposed 180° circumferentially apart to protrude radially outwardly from the outer cylindrical circumference of proximal end surface 52 of bolt 3; the smallest cross-sectional features of tee-shaped detents 29, 30 are legs 46, 46, which are configured to pop into grooves 31, 32 after rotation of bolt 3 under the force applied by key 10, thereby enabling legs 46, 46 to function as the operative features of detents by engaging the side walls of flutes, or grooves 31, 32 and thereby restraining any rotational movement of the tandem combination of bolt 3 and key 10. The lengths of detents 29, 30 are matched with precision to fit the width of chamber 35 (which is important during rotation of detents 29, 30 within chamber 35 because detents 29, 30 serve as guides during rotation) in tandem with front teeth 14, 14 working as guide pins along internal axially oriented grooves 31, 32, and 33, 34. The arcuate lengths of cross-arms 36, 37 on detents 29, 30 are less than, or approximately equal to the arcuate circumferential widths of grooves 33, 34, thereby accommodating axial reciprocation of the entireties of detents 29, 30. The arcuate lengths of cross-arms 36, 37 are greater than the arcuate circumferential widths of grooves 31, 32; consequently, subsequent to entry of legs 46, 46 into grooves 31, 32, cross-arms 36, 37 are unable to enter into grooves 31, 32 and thereby obstruct farther axial passage of detents 29, 30 while legs 46, 46 abut against the sidewalls of grooves 31, 32 and prevent rotational movement of bolt 3 within bore 18.

The lock and key mechanism accommodate a wide range of axial travel that depends on the length and geometry of such components as casing 2, bolt 3 and spring 5 all together and angular rotation relative to the initial position of front teeth 14. The angle of rotation depends on geometry of internal guide grooves 31, 32 and 33, 34 and varies from approximately 20° to 160° grooves 31, 32 and 33, 34 are machined as axially straight, or alternatively, between 0° to 180° when grooves 31, 32 and 33, 34 are machined as helical, axially extending flutes.

Although tee-shaped detents 29, 30 are disposed 180° circumferentially apart to protrude radially outwardly from the outer cylindrical circumference of proximal end surface 52 of bolt 3, in an alternative embodiment, detents 29, 30 may have inverted L-shapes, with the vertical leg portions of the L-shapes entering into grooves 31, 32. In one L-shape embodiment, both the base and leg of the L-shape lie adjoining the cylindrical circumferential exterior of bolt 3 with an orientation similar to the tee-shaped detents. Alternatively, grooves 31, 32 may be machined deeper in the radial direction into casing 2 and the horizontal base portions of the L-shapes of detents 36, 37 may extend radially outwardly from circumferential surface 52. In these alternative embodiments, the legs 46, 46 of detents 29, 30 are configured to pop into grooves 31, 32 after rotation of bolt 3 under the force applied by key 10, thereby enabling legs 46, 46 to functions as the operative features of detents by restraining rotational movement of the tandem combination of bolt 3 and key 10. In still other embodiments, either a single detent 29 or 30, or three or more detents may be employed.

Spring 5 may be constructed as a Belleville washer or constructed with a cylindrical or conical shape, or as a wave spring or as another compressible, resilient element. Moreover, the structure of these safing locks is amenable to working either without a safety release incorporated into lock 1 or, alternatively, with a safety release that when engaged prevents key 10 from being removed after the mechanism is locked by the same key following a sequence of axial and rotational movements. With additional features, the safing key may be released internally by an either an external mechanical or electrical or optically operated features, and has a detent that provides audible feedback when mechanism is locked and securing the mechanism from accidental unlocking when a safety release feature is not desired in the safe and arm mechanism.

What I claim is:

1. A safing lock, comprising:

an elongate casing perforated by an axial bore partially obstructed by radially extending surfaces, said bore bearing axially extending flutes leading into a circumferentially extending chamber;

a bolt rotatably received within said bore, said bolt positioning at a proximal end of said axial bore, the bolt having a key port bearing sets of peripheral slots oriented to retentively receive radially extending teeth of a key inserted into said port, and the key port bearing radially protruding detents axially reciprocating within said flutes and rotationally traversing said chamber upon rotation of said bolt by the key;

an interlocking element borne by a distal end of said bolt with a disposition to operatively engage an arming device; and a resilient element located within said bore between said bore and said bolt amenable to compression as said bolt is forced axially against said resilient element and said detents travel axially along said flutes and are received within said chamber.

2. The safing lock of claim 1, comprised of one of said flutes and one of said slots being alignable to concurrently receive one of said radially extending teeth.

3. The safing lock of claim 1, comprised of one pair of said flutes and one pair of said slots being alignable to concurrently receive one pair of said radially extending teeth.

4. The safing lock of claim 1, comprised of said casing bearing a boss spaced-apart from said chamber, obstructing rotation of the key after passage of the teeth axially along a first pair of said flutes and circumferentially along said chamber into axial alignment with a second pair of said flutes.

5. The safing lock of claim 1, comprised of:

one of said flutes and one of said slots being alignable to concurrently receive one of said radially extending teeth; and said casing bearing a boss spaced-apart from said chamber, obstructing rotation of the key after passage of the teeth axially along a first pair of said flutes and circumferentially along said chamber into axial alignment with a second pair of said flutes.

6. The safing lock of claim 1, comprised of:

said casing obstructing rotation of the key after passage of the teeth axially along a first pair of said flutes and circumferentially along said chamber into axial alignment with a second pair of said flutes.

7. The safing lock of claim 1, comprised of:

one of said flutes and one of said slots being alignable to concurrently receive one of said radially extending teeth; and said casing obstructing rotation of the key after passage of the teeth axially along a first pair of said flutes and circumferentially along said chamber into axial alignment with a second pair of said flutes.

8. The safing lock of claim 1, comprised of:

said casing obstructing rotation of the key after passage of the teeth axially along a first pair of said flutes and circumferentially along said chamber into axial alignment with a second pair of said flutes; and said second pair of said flutes receiving the teeth from said chamber while accommodating limited axial travel of the teeth.

9. The safing lock of claim 1, comprised of:

one of said flutes and one of said slots being alignable to concurrently receive one of said radially extending teeth;

said casing obstructing rotation of the key after passage of the teeth axially along a first pair of said flutes and circumferentially along said chamber into axial alignment with a second pair of said flutes; and said second pair of said flutes receiving the teeth from said chamber while accommodating limited axial travel of the teeth.

10. The safing lock of claim 1, wherein the radially extending teeth of the key comprises a first radially extending tooth insertable into one of said slots and one of said flutes.

11. A safing lock, comprising:

an elongate casing perforated by an axial bore obstructed by radially extending surfaces, said bore bearing axially extending flutes of different widths leading into a circumferentially extending chamber;

a bolt movably held within said bore, said bolt comprising a key port, and a radially protruding detent having a first width axially reciprocating within a wider one of said flutes and a second and lesser width axially reciprocating within a narrower one of said flutes, said detent rotatably traveling between said flutes via said chamber;

an interlocking element borne by a distal end of said bolt with a disposition to operatively engage an arming device; and a resilient element located within said bore biasing said bolt to travel axially relative to said casing.

12. The safing lock of claim 11, comprised of a key retainer and one of said flutes being alignable to concurrently receive a radially extending tooth borne by a key introduced into said bore.

13. The safing lock of claim 11, comprised of said casing bearing a boss spaced-apart from said chamber, obstructing rotation of a key introduced within said bore after passage of a tooth borne by the key axially along a first of said flutes and circumferentially along said chamber into axial alignment with a second of said flutes.

14. The safing lock of claim 11, comprised of:

a key retainer and one of said flutes being alignable to concurrently receive a radially extending tooth borne by a key; and said casing bearing a boss spaced-apart from said chamber, obstructing rotation of the key after introduction into said bore and passage of the tooth axially along a first of said flutes and circumferentially along said chamber into axial alignment with a second of said flutes.

15. The safing lock of claim 11, comprised of:

said casing obstructing rotation of a key after passage of a tooth borne by the key axially along a first of said flutes and circumferentially along said chamber into axial alignment with a second of said flutes.

16. The safing lock of claim 11, comprised of:

one of said flutes and a slot being alignable to concurrently receive a radially extending tooth borne by a key; and said casing obstructing rotation of the key after passage of the tooth axially along a first of said flutes and circumferentially along said chamber into axial alignment with a second of said flutes.

17. The safing lock of claim 11, comprised of:

said casing obstructing rotation of a key after passage of the key axially along a first of said flutes and circumferentially along said chamber into axial alignment with a second of said flutes; and said second of said flutes receiving the key from said chamber while accommodating limited axial travel of the key.

18. The safing lock of claim 11, comprised of:

a key retainer and one of said flutes being alignable to concurrently receive a radially extending tooth borne by a key;

said casing obstructing rotation of the key after passage of the tooth axially along a first of said flutes and circumferentially along said chamber into axial alignment with a second of said flutes; and said second of said flutes receiving the tooth from said chamber while accommodating limited axial travel of the tooth.

19. The safing lock of claim 11, comprised of a key with a distal portion having a terminal end bearing a first radially extending tooth insertable between a key retainer and one of said flutes.

20. A safing lock, comprising:

an elongate casing perforated by an axial bore obstructed by radially extending surfaces, said bore bearing axially extending flutes of different widths leading into a circumferentially extending chamber;

a bolt movably held within said bore and oriented by said casing to be operationally restrained by an arming device, said bolt comprising a key port, and a radially protruding detent having a first width axially reciprocating within a wider one of said flutes and a second and lesser width axially reciprocating within a narrower one of said flutes, said detent rotatably traveling between said flutes via said chamber;

an interlocking element borne by a distal end of said bolt with a disposition to operatively engage and be retained by an arming device; and a resilient element located within said bore biasing said bolt to travel axially relative to said casing.

* * * * *